US009593654B2

(12) United States Patent
Martinsson et al.

(10) Patent No.: US 9,593,654 B2
(45) Date of Patent: Mar. 14, 2017

(54) INJECTOR SLEEVE

(71) Applicant: VOLVO LASTVAGNAR AB, Gothenburg (SE)

(72) Inventors: Morgan Martinsson, Kungälv (SE); Harald Karlsson, Göteborg (SE)

(73) Assignee: Volvo Lastvagnar AB, Göteborg (SE)

( * ) Notice: Subject to any disclaimer, the term of this patent is extended or adjusted under 35 U.S.C. 154(b) by 107 days.

(21) Appl. No.: 14/512,912

(22) Filed: Oct. 13, 2014

(65) Prior Publication Data

US 2015/0027194 A1 Jan. 29, 2015

Related U.S. Application Data

(62) Division of application No. 13/036,049, filed on Feb. 28, 2011, now Pat. No. 8,960,156.

(51) Int. Cl.

| | |
|---|---|
| ***F02M 61/16*** | (2006.01) |
| ***B21D 53/84*** | (2006.01) |
| ***F02F 11/00*** | (2006.01) |

(52) U.S. Cl.

CPC ..... *F02M 61/166* (2013.01); *B21D 53/84* (2013.01); *F02F 11/002* (2013.01); *F02M 61/168* (2013.01); *F02M 2200/8053* (2013.01); *F02M 2200/9061* (2013.01)

(58) Field of Classification Search

CPC .. B21D 37/16; B21B 45/0203; F02M 61/166; F02M 61/168; F02M 2200/0853; F02M 2200/9061; F02M 2200/8053

USPC ..... 123/470; 72/352, 370.1, 342.2, 354.6, 72/354.8, 355.4, 355.6, 358

See application file for complete search history.

(56) References Cited

U.S. PATENT DOCUMENTS 5,345,913 A * 9/1994 Belshaw ..... F02M 57/02 123/470
2015/0122918 A1* 5/2015 Aurich ..... F02M 51/0678 239/584

FOREIGN PATENT DOCUMENTS

GB 1 262 164 * 2/1972 ..... F02M 61/14

* cited by examiner

*Primary Examiner* — Hai Huynh
(74) *Attorney, Agent, or Firm* — WRB-IP LLP

(57) ABSTRACT

An injector sleeve adapted to be mounted in a cylinder head of an internal combustion engine, where the injector sleeve comprises a tapered inner surface which constitutes a sealing surface for an injector, where the hardness of the tapered inner surface is higher than the hardness of the outer surface of the injector sleeve. The injector sleeve is produced in a cold forming process. The advantage of the invention is that the injector sleeve is provided with a sealing surface for an injector which is harder than the outer surface of the injector sleeve. In this way, a sealing surface for an injector having small tolerances is obtained without further machining, where the outer surface may be turned to the desired dimensions.

7 Claims, 2 Drawing Sheets

INJECTOR SLEEVE

The present application is a divisional of U.S. application Ser. No. 13/036,049, filed Feb. 28, 2011.

TECHNICAL FIELD

The present invention relates to an injector sleeve to be used in an internal combustion engine according to the preamble of claim 1. Such an injector sleeve is suitable to be used with injectors for diesel engines.

BACKGROUND ART

Mast modern diesel engines are provided with fuel injectors in a common rail configuration. In a common rail system, a high pressure pump supplies fuel at high pressure to a pressure accumulator, the common fuel rail. All the fuel injectors of the engine are supplied by the common fuel rail. In this way, one high pressure pump is sufficient. Older diesel engine systems using unit injectors have one pump for each injector. Due to the higher pressure used in modern diesel engines, there are increased requirements on the sealing between the injector and the cylinder head. Since the injector must be possible to remove for inspection and replacement, the sealing must be completely tight when the injector is mounted. At the same time, it must be possible to remove the injector for inspections and to replace the injector without damage to the cylinder head.

One way of solving, or at least improving this problem is to use a separate injector sleeve that is mounted in the cylinder head and in which the injector is mounted. In diesel engines using unit injectors having a relatively low pressure, deformable injector sleeves may be used. One example of such a solution is described in U.S. Pat. No. 3,334,617, in which an injector assembly including an injector-receiving copper tube extending through the coolant water jacket is shown. The sealing force is obtained by clamping the injector against an annular surface of the tube interior, where the tube end is deformed into a counter bore on the cylinder head surface. Resilient sealing means are also used to prevent leakage through the upper wall opening of the cylinder head. The deformable injector tube is deformed during installation by the clamping force of the injector in order to retain the injector tube in the cylinder head and to form a combustion seal in order to remove the injector tube, the injector tube must be destroyed because the deformation of the injector tube makes it impossible to remove the injector tube intact. During removal, there is a risk that fragments of the injector tube may fall into the combustion chamber leading to possible failure of the engine. The removed injector tube must be discarded and must be replaced with a new component.

Further, the use of a deformable injector tube may decrease the long term stability of the injector assembly since the material may deflect over time and may lose the sealing capability. Since the injector tube is designed to provide both the combustion seal and the cooling liquid seal, any damage to the injector tube could potentially allow both combustion and cooling liquid leakage.

EP 0654601 B discloses an injector sleeve manufactured from a relatively non-deformable material which is used in conjunction with seal rings to establish a coolant seal between the cooling liquid jacket and a fuel injector. An injector cone has a tapered lower portion which is seated in a frusto-conical portion disposed within a cylinder head to establish an independent combustion seal. In this way, a separate coolant seal for the cooling liquid is provided by one pail and several sealing rings, and a separate combustion seal is provided by another part. The combustion seal relies on a conical surface having a slightly smaller angle than the corresponding surface of the cylinder head.

Such a seal requires a high degree of precision during manufacture. Further, the material requires some kind of hardening treatment after the machining of the parts in order to prevent deformation of the components. Even after such a treatment, some plastic deformation may occur during use in an engine due to high pressure and high temperatures.

There is thus room for an improved injector sleeve.

DISCLOSURE OF INVENTION

An object of the invention is therefore to provide an improved injector sleeve with improved mechanical properties. A further object of the invention is to provide an improved injector sleeve which is provided with a sealing surface for an injector which is harder than the outer surface of the injector sleeve. A further object of the invention is to provide an injector sleeve which is cost effective to produce.

The solution to the problem according to the invention is described in the characterizing part of claim 1. The other claims contain advantageous further developments of the inventive injector sleeve.

In an injector sleeve adapted to be mounted in a cylinder head of an internal combustion engine, having a nozzle portion, a mid portion and an upper portion, where the mid portion comprises a tapered inner surface which constitutes a sealing surface for an injector, the object of the invention is achieved in that the hardness of the tapered inner surface is higher than the hardness of the outer surface of the injector sleeve.

By this first embodiment of the injector sleeve according to the invention, an injector sleeve which is provided with a conical or tapered sealing surface for an injector is obtained, where the injector sleeve must not be replaced when the injector is removed. This is achieved in that the sealing surface of the injector sleeve for the injector is harder than the outer surface of the injector sleeve. By providing a sealing surface that is hard enough, the sealing surface will not deform such that the injector sleeve must be replaced when the injector is removed and reinserted. There will of course be a small deflection of the sealing surface when the injector is mounted, but this deflection will not be permanent. The injector sleeve can thus be used again when the same injector is remounted or when a new injector is mounted. When using a non-deformable sealing surface, it is important that the sealing surface is provided with a surface finish that allows a proper sealing between the sealing surface and the injector, such that a gas tight sealing is provided which will prevent exhaust gas leakage from the combustion chamber. The surface tolerances must thus be small enough.

In order to obtain such a surface finish, the injector sleeve is produced in a cold forming process. The cold forming of the injector sleeve will give a very smooth surface with a high degree of roundness and will at the same time provide a surface having a high degree of hardness. These surface properties are achieved without the requirements of any machining of the surface, without the need of heat treating the surface for additional hardness or without the need of any surface coating. This in turn allows for a cost-effective production of injector sleeves. Since the inner surface of the injector sleeve is harder than the outer surface, the outer surface can still be machined to the required shape. Since the injector sleeve is to be fixedly inserted into the cylinder head, parts of the outer surface may deform some during the insertion. It is also possible to machine a sealing groove in the outer surface after the cold forming.

The hardness of the tapered sealing surface is preferably at least 10% higher than the hardness of the outer surface of the injector sleeve. Preferably, the hardness of the tapered sealing surface is higher than 350 HK, and is preferably higher than 380 HK. The hardness of the material is here measured with the Knoop hardness test HK 0.5, which is defined by the ASTM D1474 standard. Further, the section of the material having a hardness higher than 350 HK extends at least 0.5 mm into the material from the tapered sealing surface. The roundness of the tapered sealing surface is preferably better than 10 micrometers and the surface finish of the tapered sealing surface is preferably better than 1 micrometer. Such surface properties are difficult and costly to obtain by machining processes.

The injector sleeve further comprises a nozzle portion having an inwardly protruding collar which is adapted to be flared out in an opening of the cylinder head after the injector sleeve is mounted in the cylinder head. The injector sleeve is in this way secured in the axial direction without the use of any other fastening means. This will provide a gas tight sealing between the injector sleeve and the cylinder head for combustion gases from the combustion chamber.

A lower surface of the mid portion of the injector sleeve, perpendicular to the centre axis of the injector sleeve, is further provided with one or more grooves that are adapted to hold a sealing compound when the injector sleeve is mounted in the cylinder head. This will provide a gas tight sealing between the injector sleeve and the cylinder head for the cooling water in the water channel of the cylinder head. The upper portion of the injector sleeve comprises a groove that is adapted to hold a sealing ring when the injector sleeve is mounted in the cylinder head. This sealing will also provide a sealing for the cooling water between the cylinder head and the injector sleeve.

BRIEF DESCRIPTION OF DRAWINGS

The invention will be described in greater detail in the following, with reference to the attached drawing, where.

MODES FOR CARRYING OUT THE INVENTION

The embodiments of the invention with further developments described in the following are to be regarded only as examples and are in no way to limit the scope of the protection provided by the patent claims.

Figure 1:
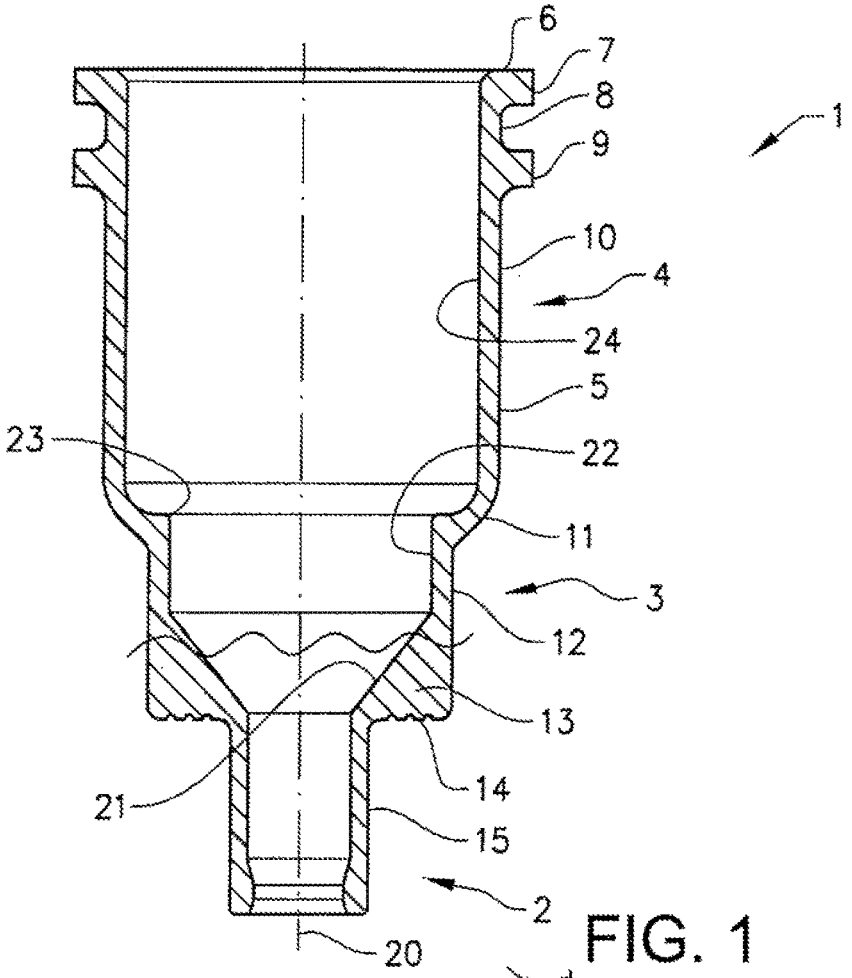
FIG. 1 shows a cut view of an injector sleeve according to the invention.
Figure 2:
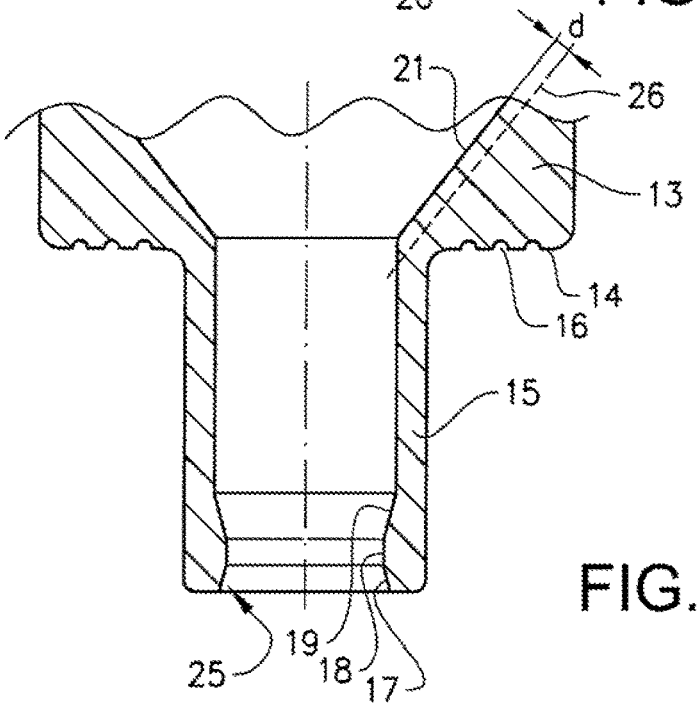
FIG. 2 shows a detail of the injector sleeve according to FIG. 1.

FIGS. 1 and 2 shows an injector sleeve 1 according to the invention for the use in an internal combustion engine. The injector sleeve is circular with a centre axis 20 and comprises a lower nozzle portion 2, a mid portion 3 and an upper portion 4. The outer surface of the injector sleeve is denoted 5 and the inner surface is denoted 24. The upper portion is provided with an upper surface 6 which may be used when pushing the injector sleeve into the cylinder head. The upper portion further comprises an upper annular protrusion 7 and a lower annular protrusion 9 which extends outwards from the outer surface and which forms a groove 8 in between them. The groove 8 is adapted to hold a sealing ring 30 that will provide an upper seal between the injector sleeve and the coolant channel in the cylinder head. The upper portion comprises a side wall 10 and a shoulder 11 that connects the upper portion 4 with the mid portion 3. The inner part of the shoulder is provided with a knee 23 that can also be used as contact surface when pushing the injector sleeve into the cylinder head. The diameter of the mid portion of the injector sleeve is reduced compared with the upper portion.

The mid portion 3 comprises a cylindrical portion 12 having an inner surface 22 and a tapered portion 13 having a tapered, conical sealing surface 21. The conical sealing surface 21 is adapted to provide the sealing surface between the injector and the injector sleeve. If the tolerances of the sealing surface are small enough and the hardness of this sealing surface is high enough, no external sealing means are necessary. An injector can thus be removed from the injector sleeve and reinserted in the injector sleeve without the need to replace the injector sleeve or any sealing means, such as sealing rings. The sealing surface is therefore produced with very high precision and is also provided with a very hard surface. In order to obtain such a sealing surface, the injector sleeve is produced in a cold forming process. The material is preferably a stainless steel material. In this way, a roundness of the sealing surface that is below 10 micrometers can be obtained, and a surface finish of the sealing surface that is below 1 micrometer can be obtained. The roundness is obtained by using the minimum zone circle definition, the surface finish is evaluated according to the $R_{zDIN}$-definition.

The hardness of the tapered sealing surface is preferably at least 10% higher than the hardness of the material at a distance d into the material. The distance is defined as a plane 26 that is parallel to the sealing surface 21 and is positioned with a distance d from the sealing surface, where d is 0.5 mm in the shown example. At a distance of about 1.0 mm into the material, the hardness of the material is approximately the same as the hardness of the outer surface of the injector sleeve.

A hardness of the sealing surface that is harder than 350 HK and preferably harder than 380 HK is obtained at the same time in the cold forming process. The hardness of the material is here measured with the Knoop hardness test HK 0.5, which is defined by the ASTM D1474 standard. The hardness of the material will extend into the material from the sealing surface such that the section of the material having a hardness higher than 350 HK extends at least 0.5 mm into the material, at plane 26. In this way, the sealing surface will not deform when the injector is mounted, but will only deflect some.

It is also possible to make the sealing surface 21 somewhat spherical with a relatively large radius, preferably larger than the radius of the injector sleeve. A spherical sealing surface 21 is of advantage for injectors having a conical cap nut with a planar contact surface.

The advantage of the inventive injector sleeve is that such surface properties can be obtained without the need of machining and heat treatment. When the injector sleeve is cold formed, the interior of the injector sleeve is ready. The outer surface of the injector sleeve is however still raw and requires some machining before the final shape is obtained. The outer surface of the injector sleeve will not be as hard as the inner sealing surface, and a simple turning of the outer surface is enough to obtain the final shape. Since the injector sleeve will be fixedly mounted in the cylinder head, it is of advantage that the outer surface is not as hard as the inner sealing surface. The outer surface may thus deform some during the mounting. The hardness of the tapered sealing surface is preferably at least 10% higher than the hardness of the outer surface of the injector sleeve.

The lower surface 14 of the mid portion is provided with one or more grooves 16. A viscous sealant is applied to the lower surface before the injector sleeve is mounted in the cylinder head, and the grooves will aid the sealing between the injector sleeve and the cylinder head, such that the sealing of the coolant channel is permeable.

During the manufacture of the injector sleeve, the inner of the upper portion and the mid portion are formed to the final shape in the cold forming process. The injector sleeve also comprises a lower nozzle portion 2 with a cylindrical portion 15, having a smaller diameter than the mid portion. The nozzle portion receives its final shape in a later machining stage. The end region of the nozzle portion comprises a collar 25 having a tapered surface 17, a mid surface 18 and a tapered surface 19. The collar is adapted to be flared out in an opening of the cylinder head after the injector sleeve is mounted in the cylinder head. The injector sleeve is in this way secured in the axial direction without the use of any other fastening means. This will provide a gas tight sealing between the injector sleeve and the cylinder head for combustion gases from the combustion chamber.

Figure 3:
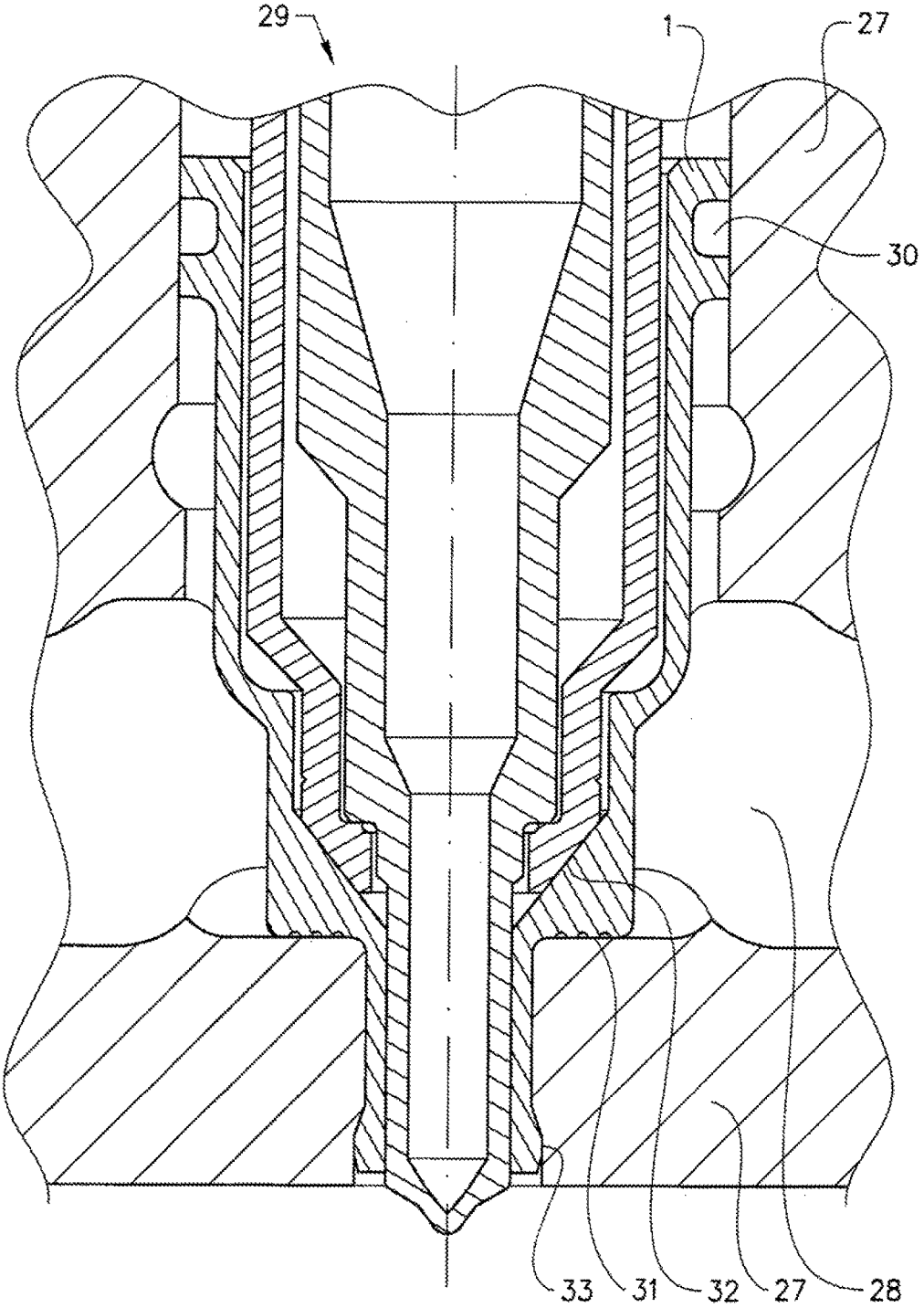
FIG. 3 shows a cut view of an injector sleeve according to the invention with an injector mounted in a cylinder head.

FIG. 3 shows a cut view of an injector sleeve 1 mounted in a cylinder head 27. The injector sleeve is pushed into the cylinder head with appropriate mounting tools, bearing on the upper surface 6 and/or the knee 23. A sealing ring 30 is provided in the groove 8 and a viscous sealing compound 31 is applied on the lower surface 14 before the injector sleeve is inserted. When the injector sleeve is inserted to the final position, the collar 25 is flared out against the opening surface 33 of the cylinder head. The injector sleeve is now fixedly mounted in the cylinder head and proper sealing is provided between the injector sleeve and the cylinder head, both for the coolant channel 28 and for the combustion chamber.

The injector 29 is provided with a sealing surface 32 which is adapted to bear on the conical sealing surface 21 of the injector sleeve. The injector cap nut is thus also tapered with an angle that corresponds to the angle of the sealing surface 21. The sealing surface 32 of the injector is further spherical with a relatively large radius. The radius of the spherical sealing surface is preferably larger than the outer radius of the injector cap nut. With such a large radius, and with the deflection of the mounting surfaces 21 and 32 when the injector is mounted in the injector sleeve, a gas tight seal is provided between the injector and the injector sleeve that will withstand the pressure of the combustion chamber.

Due to the spherical shape of the injector sealing surface, a circular, annular sealing area is created between the injector sealing surface 32 and the sealing surface 21 of the injector sleeve, where the injector bears on the injector sleeve. In the shown example, the diameter of the sealing area will be around 16 mm and the radius of the spherical injector sealing surface 32 is approximately 40 mm. These measures can of course eb varied depending on the type of injector.

The inventive injector sleeve is suitable both for injectors used in a common rail configuration as well as for unit injectors.

The invention is not to be regarded as being limited to the embodiments described above, a number of additional variants and modifications being possible within the scope of the subsequent patent claims.

REFERENCE SIGNS

1: Injector sleeve
2: Nozzle portion
3: Mid portion
4: Upper portion
5: Outer surface
6: Upper surface
7: Upper annular protrusion
8: Groove
9: Lower annular protrusion
10: Side wall
11: Shoulder
12: Cylindrical portion
13: Tapered portion
14: Lower surface
15: Cylindrical portion
16: Groove
17: Tapered surface
18: Contact surface
19: Tapered surface
20: Centre axis
21: Tapered sealing surface
22: Inner surface
23: Knee
24: Inner surface
25: Collar
26: Plane
27: Cylinder head
28: Coolant channel
29: Injector
30: O-ring
31: Sealing compound
32: Injector sealing surface
33: Opening surface

The invention claimed is:

1. A cold forming process for producing an injector sleeve adapted to be mounted in a cylinder head of an internal combustion engine, having a nozzle portion, a mid portion and an upper portion, where the mid portion comprises a tapered inner surface which constitutes a sealing surface for an injector, wherein the hardness of the tapered inner surface is higher than the hardness of the outer surface of the injector sleeve.

2. Method for producing an injector sleeve from a stainless steel material, comprising the step of forming at least one inner surface of the injector sleeve by using a cold forming process.

3. Method according to claim 2, where the at least one inner surface constitutes a sealing surface adapted to bear against an injector.

4. Method according to claim 2, where the inner of the injector sleeve is shaped in two consecutive cold firming steps.

5. Method according to claim 2, comprising forming at least one inner surface of injector sleeve to its final shape using a cold forming process.

6. Method according to claim 5, comprising forming another portion of the injector sleeve to its final shape by machining after the cold forming process.

7. Method for producing an injector sleeve where at least one inner surface thereof constitutes a sealing surface adapted to bear against an injector, comprising the step of forming the at least one inner surface of the injector sleeve by using a cold forming process such that a hardness of the scaling surface is at least 350 HK.

* * * * *